US008030268B2

(12) United States Patent
Gambogi et al.

(10) Patent No.: US 8,030,268 B2
(45) Date of Patent: Oct. 4, 2011

(54) CLEANING COMPOSITIONS THAT PROVIDE GREASE REMOVAL AND FRAGRANCE DELIVERY

(75) Inventors: Joan E. Gambogi, Hillsborough, NJ (US); Daniel W. Smith, Belvidere, NJ (US); Gregory Szewczyk, Flemington, NJ (US); Cynthia Murphy, Belle Mead, NJ (US); Sharon Kennedy, Randallstown, MD (US)

(73) Assignee: Colgate-Palmolive Company, New York, NY (US)

( * ) Notice: Subject to any disclaimer, the term of this patent is extended or adjusted under 35 U.S.C. 154(b) by 1247 days.

(21) Appl. No.: 11/354,137

(22) Filed: Feb. 14, 2006

(65) Prior Publication Data

US 2006/0189503 A1 Aug. 24, 2006

Related U.S. Application Data

(60) Provisional application No. 60/652,993, filed on Feb. 15, 2005.

(51) Int. Cl.
*C11D 17/00* (2006.01)

(52) U.S. Cl. ..... 510/424; 510/425; 510/426; 510/427; 510/503

(58) Field of Classification Search ..... None
See application file for complete search history.

(56) References Cited

U.S. PATENT DOCUMENTS

| | | | | |
|---|---|---|---|---|
| 2,503,280 | A | 4/1950 | Lockwood | |
| 2,507,088 | A | 5/1950 | Bradley | |
| 3,260,744 | A | 7/1966 | Ito et al. | |
| 3,372,188 | A | 3/1968 | Alston et al. | |
| 5,874,394 | A | 2/1999 | Thomas et al. | |
| 6,008,180 | A | 12/1999 | Drapier et al. | |
| 6,127,328 | A * | 10/2000 | D'Ambrogio et al. | 510/237 |
| 6,492,314 | B1 * | 12/2002 | Jakubicki et al. | 510/237 |
| 6,506,719 | B1 * | 1/2003 | Arvanitidou et al. | 510/424 |
| 2003/0092594 | A1 * | 5/2003 | Ahmed | 510/424 |
| 2003/0166499 | A1 | 9/2003 | Yang et al. | |
| 2004/0018950 | A1 | 1/2004 | Foley et al. | |
| 2004/0101504 | A1 | 5/2004 | Kinscherf et al. | |

FOREIGN PATENT DOCUMENTS

| | | |
|---|---|---|
| DE | 735 096 | 5/1943 |
| NZ | 240754 | 5/1995 |
| NZ | 240753 | 6/1995 |
| WO | WO 95/20027 | 7/1995 |
| WO | WO 97/35947 | 10/1997 |
| WO | 00/61710 A2 | 10/2000 |
| WO | WO 01/79404 | 10/2001 |
| WO | 01/96509 A1 | 12/2001 |
| WO | WO 2004/056957 | 7/2004 |

OTHER PUBLICATIONS

File History from U.S. Appl. No. 12/024,200, filed Feb. 1, 2008.

* cited by examiner

*Primary Examiner* — Necholus Ogden, Jr.
(74) *Attorney, Agent, or Firm* — Michael F. Morgan

(57) ABSTRACT

Disclosed is a cleaning composition that contains at least two surfactants selected from a cationic surfactant, a nonionic surfactants, a linear alkyl benzene sulfonate salt, a sulfated alcohol ethoxylate, an amine oxide, and an amphoteric surfactant; and a fragrance compound. The cleaning composition has composition has a Cup test value of at least about 70% of the standard reference formula and a QFR value of at least about 20%. Also disclosed are related methods of fragrance delivery including application and use of the composition.

16 Claims, No Drawings

CLEANING COMPOSITIONS THAT PROVIDE GREASE REMOVAL AND FRAGRANCE DELIVERY

CROSS REFERENCE TO RELATED APPLICATION

This application claims priority to U.S. provisional patent application Ser. No. 60/652,993, filed Feb. 15, 2005, the contents of which are incorporated herein by reference.

BACKGROUND OF THE INVENTION

When doing household chores, such as dish washing, dusting or laundry, many consumers may wish to experience a pleasant fragrance or odor as well as to recognize the cleaning attributes of their selected cleaning compositions. For example, in dish washing liquids, consumers value cleaning efficacy; however, given the choice between equally efficacious formulations, one of which promise to deliver fragrance and one of which does not, some consumers will select the formulation that promises fragrance delivery as an additional benefit.

Prior approaches to improving fragrance delivery include the inclusion of dish fragrances able to develop blooming or intense odors in to, e.g., dish washing liquids. However, these fragrances may overpower the consumer or linger to long of the cleaned surfaces. Other approaches include lowering the total surfactant level of the dish washing liquid; this approach has the disadvantage of reducing the cleaning efficacy of the dish washing composition.

Thus, there is a need in the art for a cleaning composition that delivers fragrance in an acceptable manner and exhibits a cleaning efficacy that is similar or better than the prior art compositions.

BRIEF SUMMARY OF THE INVENTION

The invention provides a cleaning composition having grease removal and fragrance delivery properties. The invention composition includes at least two surfactants, which may be a cationic surfactant, a nonionic surfactant, a linear alkyl benzene sulfonate salt, a sulfated alcohol ethoxylate, an amine oxide, and an amphoteric surfactant. A fragrance compound is also included. The composition is characterized by a Cup test value of at least about 70% of the standard reference formula.

Also provided are the above described cleaning products in enclosed in a container. The container may include a dispensing orifice that has a diameter of about 2.0 mm to about 10 mm.

Methods of delivering fragrance to a space or to the olfactory apparatus of a user are also contemplated.

DETAILED DESCRIPTION OF THE INVENTION

This invention provides a cleaning composition, especially a dish washing composition that is characterized by the properties of grease removal and fragrance delivery. Fragrance delivery includes evaluations of fragrance release and perception that can be measured quantitatively, qualitatively, objectively (via, e.g., analytical device) and/or subjectively (e.g., by perception of fragrance by user), such as fragrance release, fragrance impact, fragrance longevity, user's perception of freshness and/or elimination or amelioration of malodor. The invention also includes methods of fragrance delivery that include the cleaning composition.

The cleaning composition of the invention contains at least two surfactants, preferably three or more surfactants. The surfactants may be selected from cationic surfactants, nonionic surfactants, alkyl benzene sulfonate salts, sulfated alcohol ethoxylates, amine oxide surfactants and amphoteric surfactants.

Of each of the six groups of surfactants listed above, or any known or to be developed in the art may be suitable for use in the invention. Suitable cationic surfactants may include quaternary ammonium surfactant(s), e.g., dialkyl dimethyl ammonium chloride.

Suitable nonionic surfactants may include alkylpolyglucosides, polyoxyethylenated alcohols, and/or surfactants sold under the mark NEODOL®, available from Shell Chemical, LP of Houston, Tex., United States of America.

Suitable alkyl benzene sulfonate salts include linear alkyl benzene sulfonate salts, those having preferably having eight to eighteen carbon atoms, magnesium salts, sodium salts, and/or mixtures of any of these. For example, if one of the surfactants selected for use in the invention is an alkyl benzene sulfonate salt, a mixture of magnesium and sodium salts may be preferred. The mixture of sodium alkyl benzene sulfonate and magnesium alkyl benzene sulfonate may be used, for example, in a weight ratio of, e.g., about 5:1 to about 2:1.

Suitable sulfated alcohol ethoxylates may include those having about eight to eighteen carbon atoms and ethoxylated alkyl ether. The AEOS may preferably have about 1 to about 25 moles of ethoxylation, more preferably, about 1 to about 2; to about 3; to about 4; to about 5; to about 6; to about 7; to about 8; to about 9; to about 10 moles of ethoxylation.

Suitable amine oxide surfactants include amido propyl dimethyl amine oxides. Preferably, the compounds may have about twelve to about fourteen carbon atoms.

Suitable amphoteric surfactants include trialkyl glycine surfactant, for example cocobetaine.

As will be recognized by one of skill in the art, the amount of each of the surfactants included in the composition may be varied, depending on the specific end product desired and the selection of surfactant components included (2, 3, 4, 5, or 6). However, in an embodiment it may be desirable to include the cationic surfactant(s) in an amount of up to about 25% by weight, preferably up to about 10% by weight, more preferably up to about 3% about by weight, of the total composition.

In an embodiment it may be desirable to include the nonionic surfactant(s) in an amount of up to about 20% by weight, preferably up to about 10% by weight, more preferably up to about 5% by weight of the total composition.

In an embodiment it may be desirable to include the alkyl benzene sulfonate salt surfactant(s) in an amount of about 1% to about 40% by weight, preferably about 3% by weight to about 30% by weight, more preferably about 5% to about 20% by weight of the total composition, with attention to the relative ratio various salts (of applicable), e.g., sodium to magnesium salts, as described above.

In an embodiment it may be desirable to include the sulfated alcohol ethoxylate surfactant(s) in an amount of about 5% to about 40% by weight, preferably about 10% to about 25% by weight, more preferably about 7% to about 19% by weight.

In an embodiment it may be desirable to include the amine oxide surfactant(s) in an amount of up to about 25% by weight, preferably about 5% to about 20% by weight, more preferably about 2% to about 10% by weight.

In an embodiment it may be desirable to include the amphoteric surfactant(s) in an amount of up to about 30% by weight, preferably up to about 20% by weight, more preferably up to about 10% by weight.

The cleaning composition of the invention also includes a fragrance compound(s). The fragrance compound(s) may be any known or to be developed in the art. Preferably the fragrance compound may be selected from natural sources, or may be the fragrance composition of co-pending United States Patent Application (number not yet assigned; claiming priority to U.S. Provisional Patent Application 60/653,004 filed (Feb. 15, 2005)), the contents of which are incorporated herein by reference The compositions of the invention possess certain grease removal properties as evaluated by the Cup test method, a standard assay known to one of skill in the art. The Cup test protocol is given below:

Cup Test Protocol: 6 grams of warm liquid beef tallow and applied to the inside of a 250 ml plastic cup and it is allowed to solidify for at least 3 hours. Hot (approximately 46° C.) solutions of the cleaning composition (0.267% concentration) are poured into the plastic cups containing the grease. After fifteen minutes, the cups are emptied of the dish washing solution and allowed to air dry. The weight of the grease removed during soaking is measured and compared to the weight of grease removal using the standard reference formulation under the same conditions. The formulation of the standard reference formulation is given in Example 2, below.

Under these conditions, the composition has a Cup Test Value of at least 70%, at least about 80% or at least about 90% of the standard reference formula when evaluated as described above.

The compositions of the invention exhibit certain values of Quantified Fragrance Release (QFR) as evaluated by the test method described below. Quantified Fragrance Release (QFR) is defined as the absolute value of the sum of the peaks of measurable fragrance ingredients remaining in the dish washing water over time as measured using Solid Phase Micro Extraction or SPME. The QFR method measures the amount of fragrance that enters into the atmosphere over time as the product is used. The amount of fragrance remaining in solution is inversely proportional to the amount released. Aliquots of the dish solution are taken at time intervals of 0 to 20 minutes, and each sample is analyzed for remaining fragrance using SPME headspace analysis.

To carry out QFR analysis, an amount of neat cleaning composition (e.g., liquid dish detergent) is dissolved in water. An initial value for the amount of fragrance present in the water/cleaning composition sample is obtained.

To simulate fragrance delivery during use, the water/cleaning composition is subjected to agitation in an open vessel and samples are taken over time. For example, a rotary mixer is positioned about 2 centimeters from the bottom of a flat bottom pan. The pan is filled with 1.5 L of hot water (approx. 100 ppm hardness). Three grams of the dish product to be evaluated are placed in a disposable syringe. This sample is then injected into the tap water and stirred at 180 RPM. Determination of the fragrance remaining in each sample is done by SPME headspace analysis using the following conditions:

20 minute extraction time @ 50° C. (time fiber is exposed to HS in vial)

15 minute desorption time @ 250° C.

45 minute run-time through column.

One μl of a 2% solution of neat fragrance oil in methanol is run by direct injection on the GC/MS. The resulting fragrance peaks are compiled in a compound table, which is then used in the GC method for identification of the fragrance peaks in the samples of dish solution injected by the SPME fiber. Identification and quantification of the fragrance peaks are done using the Varian GC software.

The compositions of the invention have QFR values of at least 20%, at least 30%, at least 40%, at least 50%, at least 60%, at least 70%, at least 80% and at least 90%.

The compositions of the invention may also include other conventional additives and carriers, including, for example, alcohols, water, colorants, viscosity modifiers, antibacterial agents, antimycotic agents, aesthetic components (glitter, flakes, beads), humectants, and UV absorbers.

The invention also includes methods of delivering fragrance to a space or the olfactory apparatus of a user by employing the cleaning composition in water under agitation. By agitation it is meant any activities that disrupt the water into which the composition has been placed, thereby resulting in the volatilization of some of the components in the compositions. Agitation includes dish washing (manual or automatic), handwashing or machine washing of textiles, the motions carried out when washing one's hands, mopping or wiping of floors and surfaces, and spraying.

EXAMPLES

Example 1

Calculation of QFR

A liquid dish washing detergent of the invention was diluted at 0.2% in 45° C. water. Aliquots were taken at the time points for analysis by solid phase micro extraction GC/MS. Table I shows the results obtained:

TABLE 1

| | Time of Sampling | |
|---|---|---|
| | 0 minutes | 20 minutes |
| Limonene peak area | 14422468 | 10542571 |
| Terpinolene peak area | 376488 | 281206 |
| Total peak area | 14798956 | 10823777 |
| Quantified Fragrance Release, % | 0 | 27 |

Examples 2-4

Four Compositions of the Inventions Compared to a Standard Reference Formula Four liquid dish washing compositions of the invention and one standard reference formulation were prepared by mixing the ingredients as shown below in Table 2.

TABLE 2

| | Reference | A | B | C | D |
|---|---|---|---|---|---|
| MgLAS | 11 | 4 | 1 | 1 | 6 |
| NaLAS | 4 | 13 | 13 | 9 | 11 |
| AEOS-1.3EO | 14 | 14 | 0 | 14 | 14 |
| AEOS-7EO | 0 | 0 | 14 | 0 | 0 |
| Amine Oxide | 7 | 5 | 9 | 9 | 5 |
| SXS Hydrotrope | 3.3 | 3.3 | 3.3 | 3.3 | 3.3 |
| Salt | 0.3 | 0.3 | 0.3 | 0.3 | 0.3 |
| Ethanol | 5.5 | 5.5 | 5.5 | 5.5 | 5.5 |
| Preservative | 0.11 | 0.11 | 0.11 | 0.11 | 0.11 |
| Sequestering Agent | 0.28 | 0.28 | 0.28 | 0.28 | 0.28 |
| Water and minors (color, pH adjustment) | balance | balance | balance | balance | balance |
| Total Surfactant Level | 36 | 36 | 37 | 33 | 36 |

TABLE 2-continued

| | Reference | A | B | C | D |
|---|---|---|---|---|---|
| Quantified Fragrance Release % | 19 | 38 | 31 | 28 | 30 |
| Cup Test, % Removed | 24 | 23 | 17 | 24 | 20 |

We claim:

1. A cleaning composition comprising a mixture of a sodium alkyl benzene sulfonate and a magnesium alkyl benzene sulfonate, wherein the mixture is in a weight ratio of about 5:1 to about 2:1; and a fragrance compound, wherein the composition has a Cup test value of at least about 70% and a QFR value of at least about 20% and further comprises at least two surfactants selected from sulfated alcohol ethoxylates and an amine oxide.

2. The composition of claim 1, wherein the alkyl benzene sulfonates have eight to eighteen carbon atoms.

3. The composition of claim 1, wherein the QFR value is about 20% to about 80%.

4. The composition of claim 1, wherein the QFR value is about 30% to about 50%.

5. The composition of claim 1, wherein the Cup test value is at least about 80%.

6. The composition of claim 1, wherein the QFR value is about 30% to about 50% and the Cup test value is at least about 80%.

7. The composition of claim 1, wherein the fragrance is present in an amount of up to about 5% by weight of the total composition.

8. The composition of claim 1, wherein the fragrance is present in an amount of about 0.3to about 3% by weight of the total composition.

9. The composition of claim 1, wherein the composition is in a form selected from a liquid, a gel, a solid, a paste, and a powder.

10. The composition of claim 1, wherein the composition is in a form selected from a liquid dish washing liquid, a laundry detergent, a powder dish washing liquid, a liquid hard surface cleaner, and a gel hard surface cleaner.

11. A cleaning product comprising a composition comprising a mixture of a sodium alkyl benzene sulfonate and a magnesium alkyl benzene sulfonate, wherein the mixture is in a weight ratio of about 5:1 to about 2:1; and a fragrance compound; wherein the composition has a Cup test value of at least about 70% and a QFR value of at least about 20% and further comprising surfactants such as sulfated alcohol ethoxylates and an amine oxide;

a container comprising dispensing orifice that has a diameter of about 2.0 mm to about 10 mm.

12. The product of claim 11, wherein the container has a deformable wall.

13. A method of delivering fragrance to the olfactory apparatus of a user comprising contacting the cleaning composition of claim 1 with water under agitation.

14. The method of claim 13, wherein agitation is carried out by hand washing, manual dish washing, automatic dish washing, mopping, automatic clothes washing, manual clothes washing and wiping.

15. The method of claim 13, wherein the QFR value of is aboutb 30% to about 50%.

16. A method of delivering fragrance to a space comprising contacting the cleaning composition of claim 1 with water under agitation.

* * * * *